United States Patent [19]

Dollst

[11] Patent Number: 4,517,443

[45] Date of Patent: May 14, 1985

[54] APPARATUS FOR HEATING AND DRYING SHOES

[76] Inventor: Klaus Dollst, Averhoffstrasse 24, D-2000 Hamburg 76, Fed. Rep. of Germany

[21] Appl. No.: 558,341

[22] Filed: Dec. 5, 1983

[30] Foreign Application Priority Data

Dec. 9, 1982 [DE] Fed. Rep. of Germany ... 8234580[U]
May 13, 1983 [DE] Fed. Rep. of Germany ... 8314216[U]

[51] Int. Cl.[3] ..... A43D 95/10; H05B 3/06

[52] U.S. Cl. ..... 219/215; 12/129.4; 219/523

[58] Field of Search ..... 219/215, 523, 535; 12/129.4, 136 R, 136 A, 136 B, 136 C; 34/103, 104, 105; 223/76

[56] References Cited

U.S. PATENT DOCUMENTS

| | | | |
|---|---|---|---|
| 604,383 | 5/1898 | Goding | 12/136 R |
| 939,212 | 11/1909 | Buch | 12/129.4 |
| 985,232 | 2/1911 | Twiss | 219/215 |
| 1,054,259 | 2/1913 | Wales | 219/215 |
| 1,358,963 | 11/1920 | McGrath | 219/215 |
| 1,543,828 | 6/1925 | Doyle | 219/215 |
| 1,733,611 | 10/1929 | Lessard | 219/215 |
| 1,846,774 | 2/1932 | Watson | 12/129.4 |
| 2,063,370 | 12/1936 | Dutton | 12/129.4 |
| 2,310,847 | 2/1943 | Grau-Küpfer | 219/215 |

FOREIGN PATENT DOCUMENTS

| | | | |
|---|---|---|---|
| 1263116 | 4/1961 | France | 12/129.4 |
| 1434040 | 5/1965 | France | 219/523 |
| 57024 | 7/1924 | Sweden | 12/129.4 |

*Primary Examiner*—Roy N. Envall, Jr.
*Assistant Examiner*—Teresa J. Walberg
*Attorney, Agent, or Firm*—Staas & Halsey

[57] ABSTRACT

The apparatus for heating and drying shoes not only has a stretching member with an electrical resistance heater, but also a clip, which is fixed in an articulated manner to the stretching member. Thus, the apparatus is used not only for heating and/or drying, but simultaneously for maintaining the shape of the shoe in which it is placed. Advantageously, the joint between the clip and the stretching member is a snap connection, which is secured against detachment by the electrical resistance heater. For this purpose, the pivoting connection can be provided on the stretching member with a resilient cover plate, which engages on the clip and carries a projection braced on the electrical resistance heater. The slot in the clip for the passage of the cable can also be provided with a slef-locking element, which prevents a relative movement between the cable and clip if the cable is pulled away from the shoe apparatus.

7 Claims, 4 Drawing Figures

APPARATUS FOR HEATING AND DRYING SHOES

BACKGROUND OF THE INVENTION

The invention relates to an apparatus for heating and drying shoes, comprising a member adapted to the inner area of the shoe and in which is arranged an electrical resistance heating means.

The most varied apparatuses of the aforementioned type are known. They are either heated by filling with hot water or by an electrical resistance heating means. These apparatuses are all used solely for the heating and/or drying of shoes.

SUMMARY OF THE INVENTION

The problem to which the invention is directed, apart from heating and/or drying the shoes, is to ensure that during this process the shoe retains its shape, or is returned to its shape.

This problem is fundamentally solved by the invention comprising a member constructed as a stretching member, on whose rear end portion is provided a clip for bracing purposes in the heel area of the shoe. This ensures that a shoe, particularly if it has become wet, is not only dried, but simultaneously shaped or is maintained in its shape.

Preferably, the clip is resiliently constructed and fixed to the stretching member by means of a joint. An opening for the passage of the electrical cable for the resistance heating means is provided in the clip end braced in the heel area. A slot for the passage of the resistance heating means is also provided in the clip end braced in the heel area.

In particular, it is possible to construct the apparatus in such a way that, in the vicinity of the joint between the clip and the stretching member, a snap connection is provided, which permits a simple joining together of these parts by assembly. Following this assembly, the electrical resistance heating means is fitted, a detachment of the snap connection is simultaneously prevented, because the resistance heating means is constructed and arranged in such a way that it secures the snap connection. An advantageous development of this object is to provide the snap connection having a resilient cover plate on the stretching member which engages the clip and which carries a projection braced on the electrical resistance heating means.

If the apparatus is constructed in the manner that the opening is formed as a slot for the cable and has a self-locking means with the self-locking means preventing relative movement between the cable and clip, it is also ensured that on pulling the cable from the outside, the corresponding force is not transferred to the resistance heating means and consequently no damage can occur in the connecting region between the cable and resistance heating means. The cable is displaceable in the direction of the resistance heating means, in order to ensure threading and adjustment. It is secured in the other direction. The two securing or fastening possibilities i.e., the hinge connections secured by the electrical resistance heating means on the one hand and the self-locking of the cable on the other, together ensure that there is no damage or shifting on pulling out.

BRIEF DESCRIPTION OF THE DRAWINGS

The invention is described in greater detail hereinafter relative to two non-limitative embodiments and the attached drawings, wherein.

DETAILED DESCRIPTION OF THE INVENTION

Figure 1:
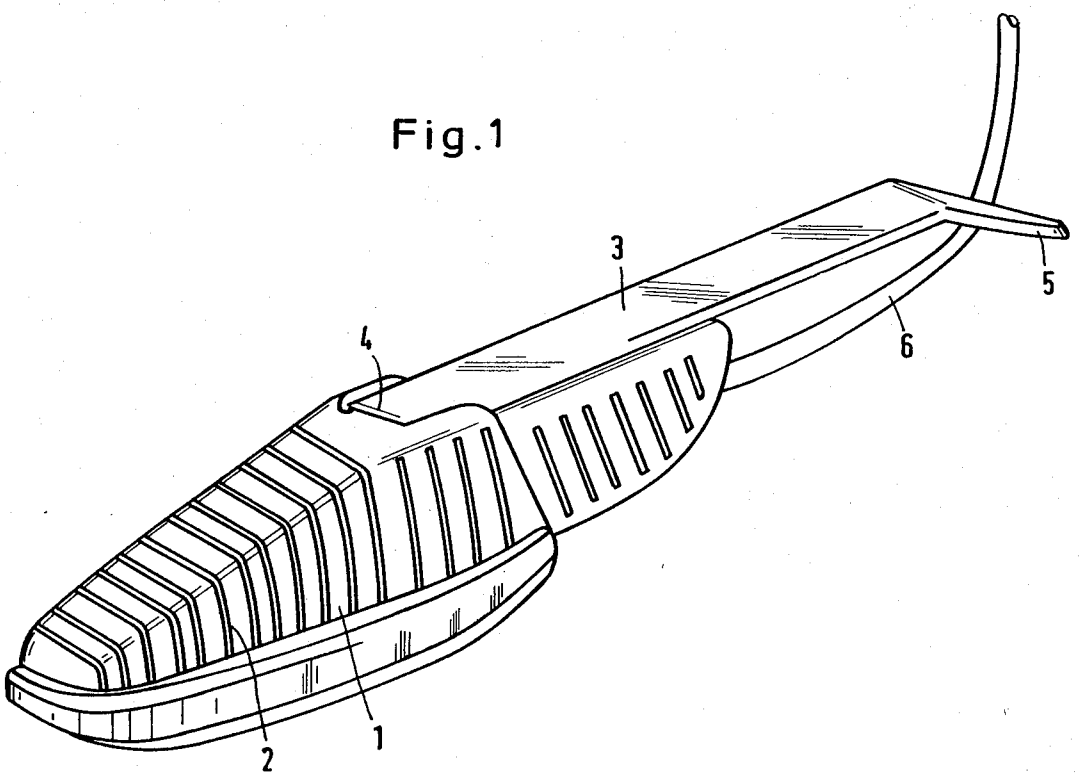
FIG. 1 is a perspective view of an embodiment of an apparatus according to the invention.
Figure 2:
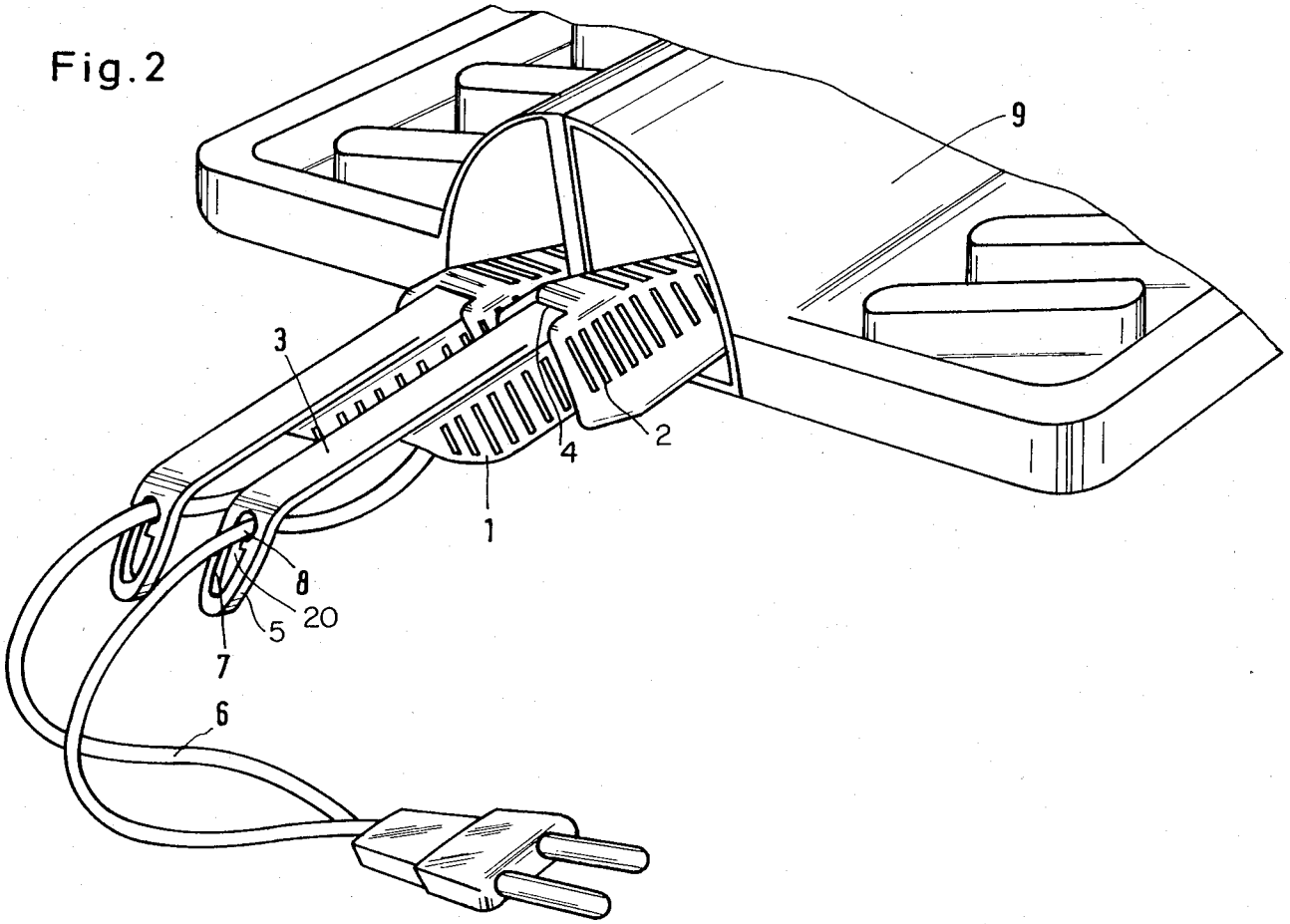
FIG. 2 is a perspective view of two apparatuses incorporating the embodiment of FIG. 1, which are juxtaposed and both located in a magazine.

The apparatus shown in FIGS. 1 and 2 comprises a stretching member, which is adapted to the shape of the interior of a shoe and which is provided with ribs or passages 2. This stretching member 1 contains an electrical resistance heating means, the heating means not shown in FIG. 1 but see heating cartridge element 13 illustrated in FIG. 3 and described hereinafter. An electrical cable 6 leads to the resistance heating means. A resiliently constructed clip 3 is fixed to the rear end portion or joint 4 of the stretching member 1 in an articulated manner.

An opening 8 for the passage of electrical cable 6 is provided in the rear, downwardly bent end 5 of clip 3. Below opening 8 is formed a slot 7, through which can be inserted the electrical resistance heating means. Opening 8 and slot 7 are interconnected by a small slit 20, through which the cable 6 can be forced into opening 8, when the electrical resistance heating means has been introduced. The electrical resistance heating means, preferably the heating cartridge element 13, and the cable 6 are manufactured together and supplied as a standard unit. For fitting purposes, the resistance heating means 13 is introduced through slot 7 and is fixed at the intended point within the stretching member 1. The cable is then forced into opening 8.

If a shoe is to be heated or dried, the apparatus is forced into the shoe and the clip 3 is deformed against its spring tension, so that the end 5 is braced in the heel region of the shoe and stretching member 1 is pressed forwards into the front inside of the shoe. There is a pivoting movement around joint 4. If the cable is now pulled in order to free the apparatus from the shoe again and which is not in fact desired, no damage occurs, because the clip 3 is released from the heel as a result of this. Moreover, between end 5 and the stretching member 1 a loop is formed in the cable during stretching, which makes available a sufficient cable length to accompany this movement of the clip 3.

In the case of certain shoes, where stretching is not desired or not possible, the clip can be flipped upwards, so that it remains inactive and only serves to guide the cable. Moreover, the two shoe dryers for a pair of shoes can also be stored when not in use in a suitable storage container, such as a magazine 9 illustrated in FIG. 2.

Figure 3:
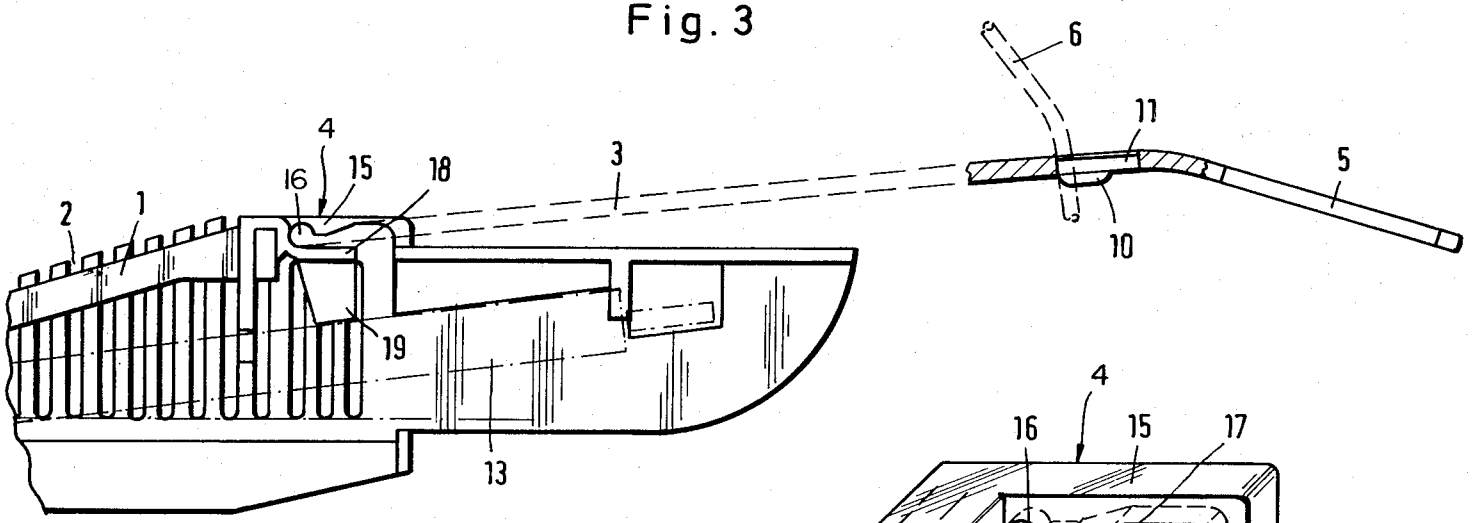
FIG. 3 is a part sectional side view through another embodiment of an apparatus according to the invention wherein certain details have been modified from the embodiment of FIG. 1.
Figure 4:
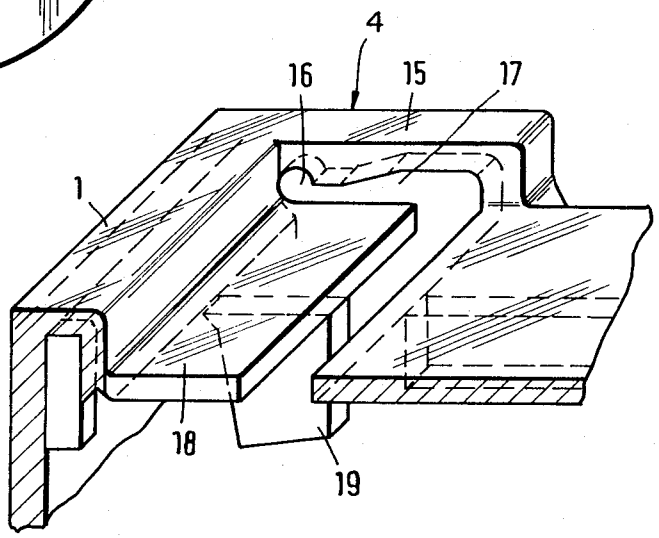
FIG. 4 is a perspective view of the hinge connection of clip and stretching member for the embodiment of FIG. 3.

The embodiment of the invention shown in FIGS. 3 and 4 differs from that embodiment of FIGS. 1 and 2, mainly through the construction of joint 4. Clip 3 is resiliently constructed and can be pivotally swung up and down at joint 4. Joint 4 has webs 15 and a cover plate 18, which together form two slots 17 that terminate in approximately circular openings 16. The area of slot 17 immediately in front of opening 16 is narrower than the area of the slot 17 farthest away from opening 16. A projection 19 is provided on the bottom of cover plate 18 for engaging the heating means as described hereinafter.

Clip 3 has two laterally projecting pins for corresponding insertion in respective slots 17. The pins of the clip can be forced through the constriction of the joint 4 by exerting a certain amount of force, with cover plate 18 moving resiliently downwards. The pins then snap into the two openings 16 and the clip 3 can easily be swung up and down. If the electrical resistance heating means, preferably the heater cartridge element 13, as illustrated in FIG. 3, is now inserted and fitted into position, its top surface engages projection 19 and cover plate 18 can no longer be moved resiliently downwards. The pulling out of the clip 3 is reliably prevented, because the pins of the clip can no longer move out of opening 16. This ensures an easy fitting of the simply constructed clip and prevents the hinge connection from being undesirably detached again in the case of a pulling force on cable 6.

A slot 11, corresponding to the opening 8 of the embodiment according to FIGS. 1 and 2, and is merely displaced somewhat in the direction of stretching member 1 and is provided with a self-locking means 10 through which cable 6 is passed. Self-locking means 10 ensures that, if cable 6 is pulled, the latter is not moved outwards relative to clip 3, i.e., the cable portion between the clip and the resistance heating means is not shortened. The self-locking means 10 does not act in the other direction, so that the cable can be easily fitted and adjusted. If cable 6 is pulled and the self-locking means engages, firstly the clip is released from the heel area of the shoe. If, in an undesired manner, further pulling takes place on the cable, the complete apparatus moves out of the shoe. Even as a result of this undesired pulling of the cable, no damage takes place to the apparatus, because the self-locking means and the setting of the cable length ensure that there is a sufficient cable length between resistance heating means 13 and clip 3.

The fastenings in the vicinity of joint 4 and slot 11 cooperate to prevent damage when pulling on cable 6 occurs. For example, this frequently occurs when the apparatus is used in top boots and, when it is desired to release the apparatus, the user pulls on the cable rather than grasping the apparatus in the boot.

What is claimed is:

1. An apparatus for heating and drying a shoe having an inner area and a heel area, the apparatus comprising:

(a) a stretching member having a forward portion adapted to the inner area of the shoe and a rear portion;

(b) electrical resistance heating means arranged in said stretching member;

(c) a clip joined to the rear portion of the stretching member for bracing in the heel area of the shoe; and (d) means for joining the clip to the rear portion of the stretching member including a snap connection secured against detachment by the electrical resistance heating mean.

2. An apparatus according to claim 1, wherein the clip is resiliently constructed.

3. An apparatus according to claim 1, wherein the electrical resistance heating means comprises a heater element in said stretching member and an electrical cable connected thereto and the clip has an opening for passage of the cable therethrough from the heater element to outside the heel area of the shoe.

4. An apparatus according to claim 3, wherein the clip further comprises a slot for passage of the resistance heating means adjacent said clip opening.

5. An apparatus according to claim 1, wherein the snap connection has a resilient cover plate connected to the stretching member for engaging the clip and having a projection for bracing against the electrical resistance heating means.

6. An apparatus according to claim 3, wherein the opening is a slot for receiving the cable and wherein a self-locking means is positioned with said slot for preventing a relative movement between the cable and the clip when the cable is pulled in a direction outwardly from the heel area of the shoe.

7. An apparatus according to claim 4, wherein the clip has a rear, downwardly bent end for bracing in the heel area of the shoe and wherein the clip opening and slot are formed in said rear clip end and are interconnected by a small slit through which the cable can be forced into said clip opening after said heater element has been positioned in said stretching member through said slot.

* * * * *